US008087213B2

(12) United States Patent
Dhuru et al.

(10) Patent No.: US 8,087,213 B2
(45) Date of Patent: Jan. 3, 2012

(54) INTERACTIVE PRODUCT PACKAGING

(75) Inventors: Yashodhan Dhuru, Cincinnati, OH (US); Scott Niedzwecki, Cincinnati, OH (US); Scott Liu, Diamond Bar, CA (US); Michael Holman, Fishers, IN (US); Bruce Schaffer, Carmel, IN (US); Shell Bieker, Colorado Springs, CO (US); Robert Jordan Hickman, Larkspur, CO (US)

(73) Assignee: Schlage Lock Company LLC, Carmel, IN (US)

( * ) Notice: Subject to any disclaimer, the term of this patent is extended or adjusted under 35 U.S.C. 154(b) by 46 days.

(21) Appl. No.: 12/258,839

(22) Filed: Oct. 27, 2008

(65) Prior Publication Data

US 2009/0114565 A1 May 7, 2009

Related U.S. Application Data

(60) Provisional application No. 61/000,355, filed on Oct. 25, 2007.

(51) Int. Cl.
*B65B 61/00* (2006.01)

(52) U.S. Cl. ..... 53/410; 206/779

(58) Field of Classification Search ..... 206/776, 206/780, 779, 736, 745, 756, 763, 769, 471, 206/576, 580, 372, 373, 467; 53/410; 70/107
See application file for complete search history.

(56) References Cited

U.S. PATENT DOCUMENTS 4,011,741 A * 3/1977 Nolin ..... 70/107
4,142,391 A * 3/1979 Paig ..... 70/461
4,179,029 A * 12/1979 Fethke et al. ..... 206/471
6,401,932 B1 * 6/2002 Weinstein et al. ..... 206/779

OTHER PUBLICATIONS

U.S. Appl. No. 12/138,950, filed Jun. 13, 2008, Sajil John Mathachan.

* cited by examiner

*Primary Examiner* — J. Gregory Pickett
*Assistant Examiner* — Andrew Perreault
(74) *Attorney, Agent, or Firm* — Michael Best & Friedrich LLP

(57) ABSTRACT

A package and lock combination includes a package having an unopened state and including an aperture, and a lock contained within the package. The lock includes a first portion and a second portion moveable relative to the first portion for operating the lock. The first portion is substantially fixed within the package, and the second portion extends through the aperture so that the lock is operable while the lock is contained within the package and the package is in the unopened state.

23 Claims, 10 Drawing Sheets

INTERACTIVE PRODUCT PACKAGING

CROSS-REFERENCE TO RELATED APPLICATIONS

This application claims priority under 35 U.S.C. §119 to Provisional Patent Application No. 61/000,355 filed Oct. 25, 2007, the contents of which are herein incorporated by reference.

BACKGROUND

The present invention relates to product packaging, such as retail sale packaging, and to locks, such as deadbolts.

SUMMARY

The invention provides packaging that allows a consumer to "test drive" the product. More particularly, the invention provides retail packaging for a deadbolt, the packaging allowing a consumer to see the components of the deadbolt and to retract and throw the bolt, so that the consumer can feel the quality of the product. In a preferred embodiment of the invention, the thumbturn of the deadbolt is exposed so that the consumer can manipulate the thumbturn to retract and throw the bolt, while the lock is positioned in the packaging.

The invention also provides a package and lock combination including a package having an unopened state and including an aperture, and a lock contained within the package. The lock includes a first portion and a second portion moveable relative to the first portion for operating the lock. The first portion is substantially fixed within the package, and the second portion extends through the aperture so that the lock is operable while the lock is contained within the package and the package is in the unopened state.

The invention also provides a method of packaging a lock including a first portion and a second portion that is moveable relative to the first portion for operating the lock. The method includes providing a package defining an aperture, positioning the lock inside the package and substantially fixing the first portion of the lock within the package. The method further includes closing the package with the lock inside the package, and extending the second portion of the lock through the aperture to permit operation of the lock while the lock is inside the package and the package is closed.

The invention further provides a package and lock combination. The package includes an outer layer having indicia printed thereon and having a closed state. The outer layer includes a front surface, a rear surface and first and second side surfaces extending between the front and rear surfaces. The front, rear and side surfaces substantially define a rectangular solid that forms an outer perimeter of the package and lock combination. The outer layer defines a first window that extends across a portion of the first side surface, and the package also includes an inner layer comprising a substantially transparent clamshell having therein an aperture. The lock is contained within the package and is substantially fixed within the clamshell. The lock includes an exterior housing, an interior housing having a thumbturn moveable relative to the exterior housing for operating the lock, and a bolt moveable with respect to the interior housing and the exterior housing in response to movement of the thumbturn. The exterior housing, the interior housing and the bolt are held together and operational in the clamshell without the use of fasteners. The thumbturn is recessed from the outer layer and extends through the aperture adjacent the first window, such that the thumbturn is accessible through the first window and is graspable and rotatable to thereby move the bolt to operate the lock while the lock is contained within the package and the package is closed. The interior housing and bolt are contained within the clamshell and are viewable through the first window such that movement of the bolt is viewable through the first window.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
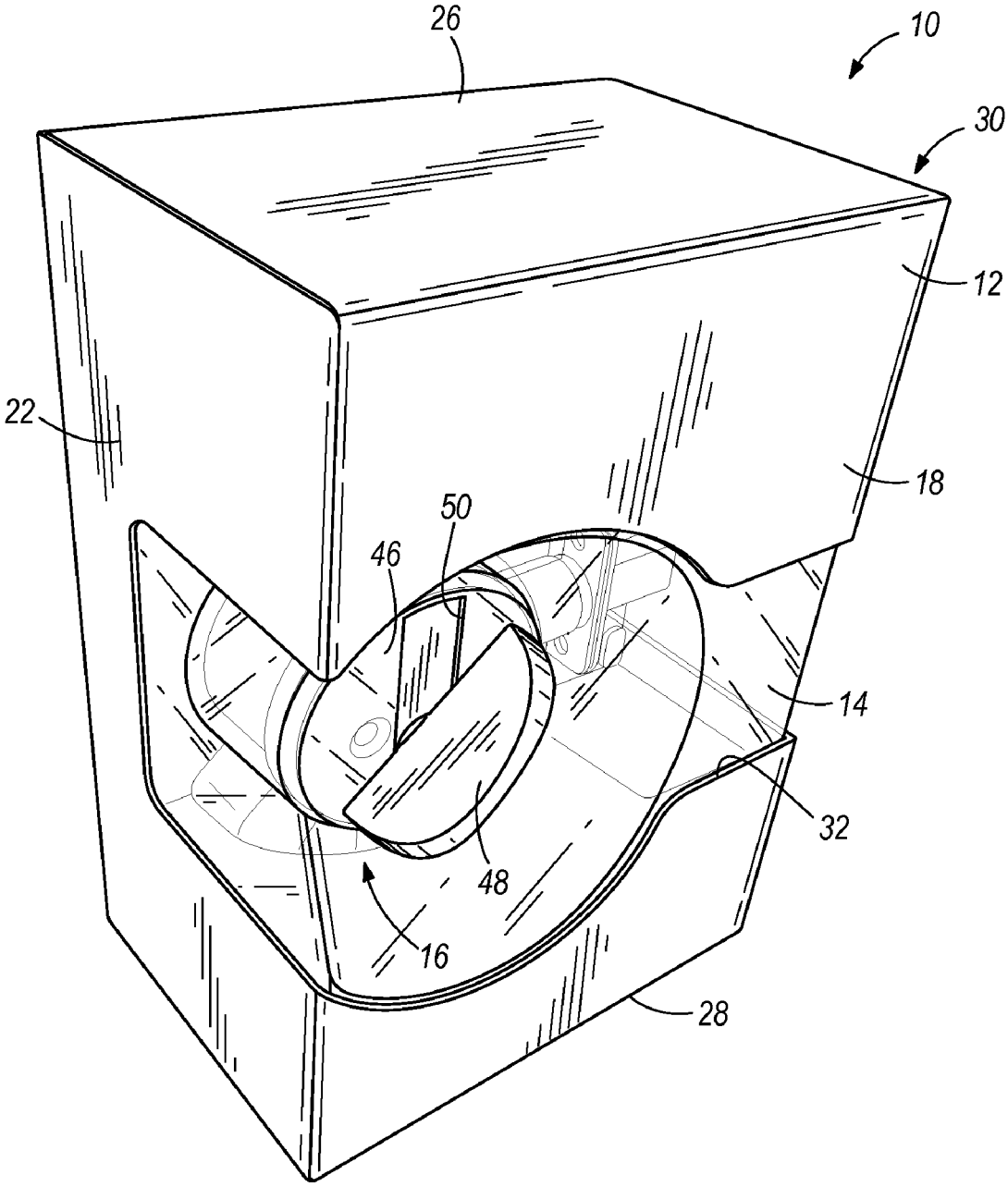
FIG. 1 is a first front perspective view of the packaging in use.
Figure 2:
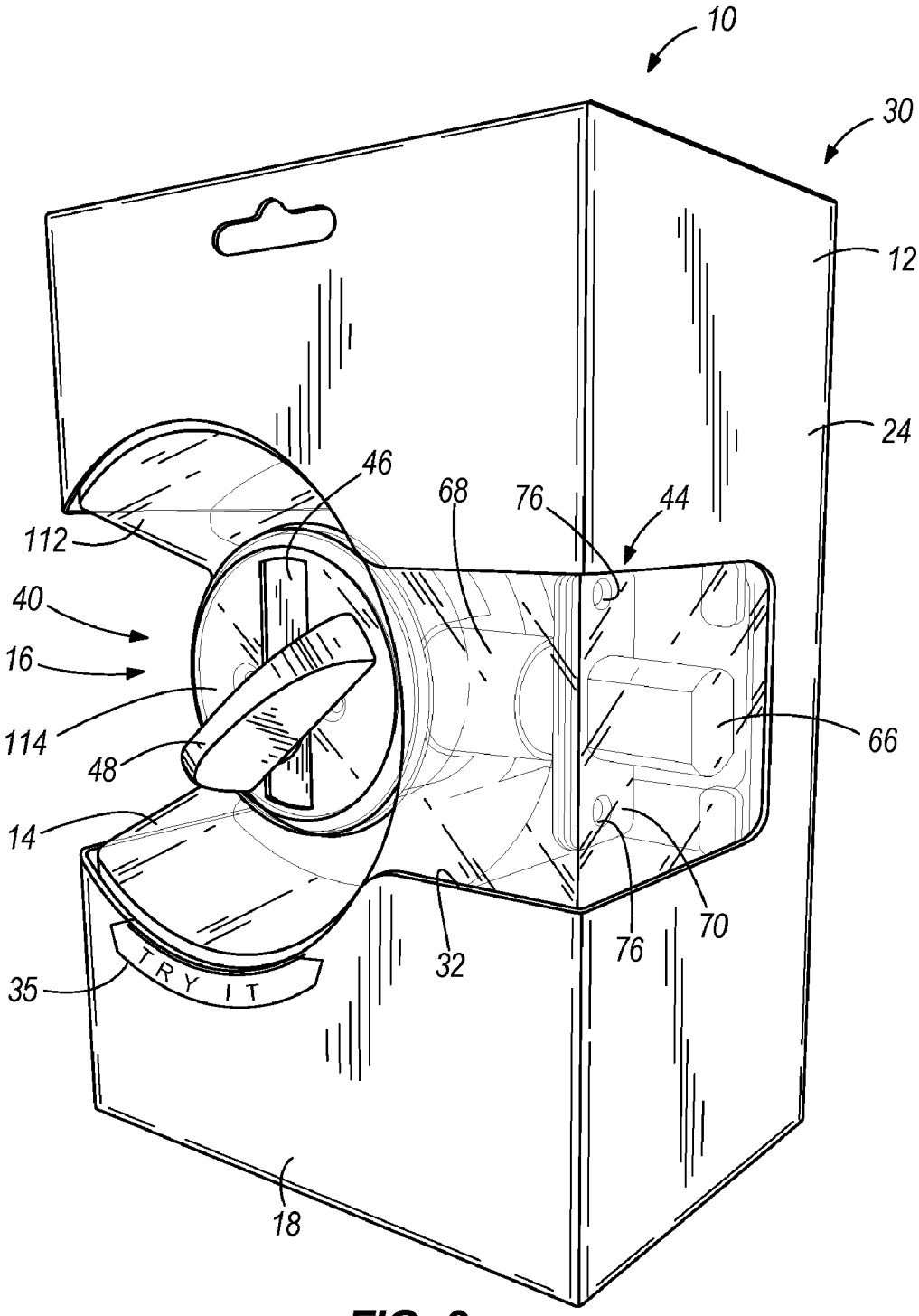
FIG. 2 is a second front perspective view of the packaging in use.
Figure 3:
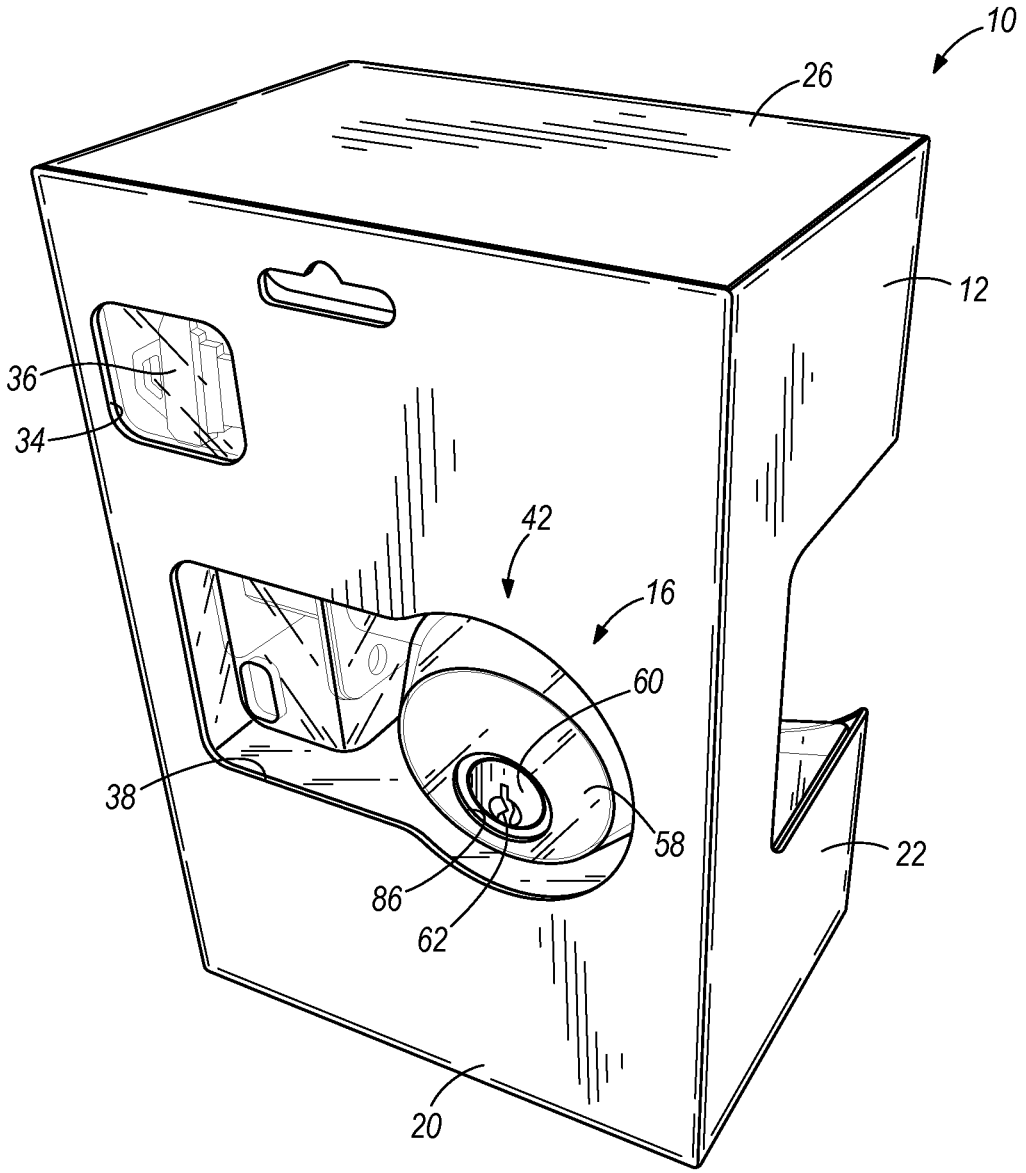
FIG. 3 is a rear perspective view of the packaging in use.

FIGS. 1-3 illustrate a package 10 including an outer layer 12 that houses an inner layer 14, which in turn houses a deadbolt lock assembly 16. The illustrated outer layer 12 includes front and rear surfaces 18, 20, left and right surfaces 22, 24 and top and bottom surfaces 26, 28 that are substantially planar and define a rectangular solid 30 that surrounds and substantially encases the deadbolt lock assembly 16. The outer layer 12 includes an inside 29 and an outside 31 (see FIG. 10). In one embodiment, the outer layer 12 comprises a cardboard box and has a plurality of indicia 35 printed on the outside 31. The term "cardboard" is used herein to encompass any paper-like material or any material that can be used in the place of a paper-like material to form a box. The illustrated inner layer 14 is a clear plastic or transparent clamshell that supports the deadbolt lock assembly 16 within the box 12. The term "clamshell" is used herein to encompass any structure including two portions or halves that are put together to close around, support and contain an object.

Figure 4:
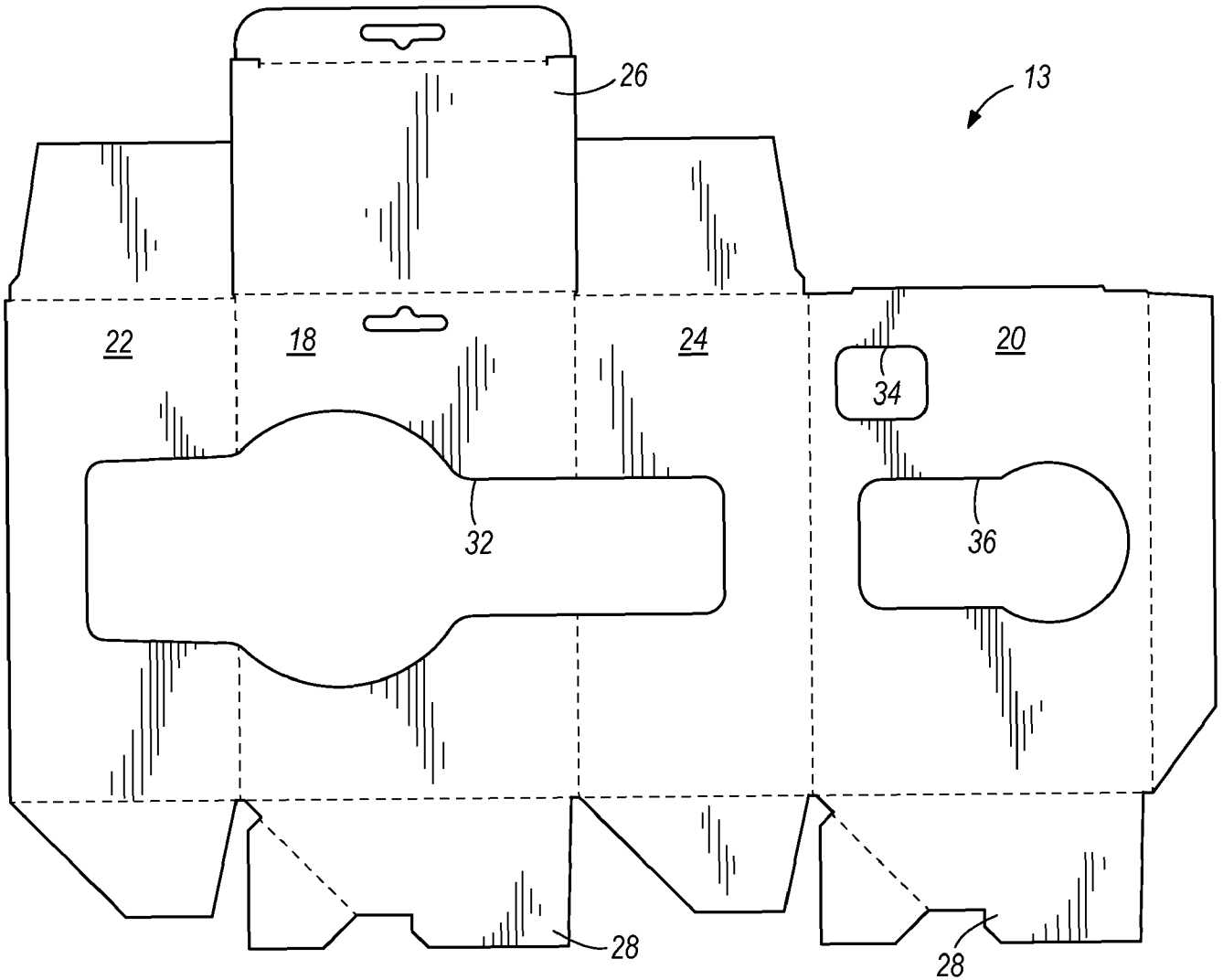
FIG. 4 shows a box blank.

The box 12 is substantially opaque and defines a first window or opening 32 that extends across a portion of the left surface 22, across the front surface 18 and across a portion of the right surface 24, as shown in FIGS. 1, 2 and 4. The first window 32 permits a consumer to view the deadbolt lock assembly 16 through the clear plastic clamshell 14 while the lock 16 is contained within the package 10 and the package 10 is in an unopened or closed state. The box 12 also defines a second window 34 positioned on the rear surface 20 (see FIGS. 3 and 4). The second window 34 permits viewing of one or more keys 36 positioned within the package 10. The box 12 further defines a third window 38 on the rear surface 20 spaced from the second window 34. The third window 38 permits a consumer to view the deadbolt lock assembly 16 while the lock 16 is contained within the package 10 and the package 10 is unopened or closed.

FIG. 4 illustrates the box 12 as a blank 13, prior to folding. The blank 13 can be folded along the illustrated dotted lines. Material is removed from the blank 13, such as by punching, to form the first window 32, the second window 34 and the third window 38. Indicia 35 (see FIG. 2) can also be printed on the blank 13 prior to folding the blank 13.

With reference to FIGS. 1-3 and 6-10, the deadbolt lock assembly 16 includes an interior housing assembly 40, an exterior housing assembly 42 and a latchbolt assembly 44, all of which are supported by the clamshell 14. The interior assembly 40 includes an interior faceplate 46 and an interior actuator, such as thumbturn 48. The thumbturn 48 is coupled to a driver 52 and is rotatable with the driver 52 (see FIG. 6). Fasteners can extend through respective first and second apertures 56 in the interior faceplate 46 to couple the interior assembly 40 to the exterior assembly 42 and the latchbolt assembly 44.

The exterior assembly 42 includes an escutcheon or housing 58 that substantially surrounds a lock cylinder 60 and supports the lock cylinder 60 for rotation within the housing 58. The lock cylinder 60 includes a key slot 62 that receives the key(s) 36. The lock cylinder 60 is also coupled to the driver 52, to cause the driver 52 to rotate in response to rotation of a key 36 therein. The exterior housing assembly 42 includes a collar 102. The collar 102 is sized to a standard door width, such that when installed, the collar 102 can retain the lock 16 within the door. The collar 102 includes left and right side recesses 104.

The latchbolt assembly 44 includes a bolt 66, a yoke collar 68 and a plate 70. The bolt 66 is slidable inside the yoke collar 68, such that the bolt 66 can extend out of the yoke collar 68 in a locked position (shown in FIG. 7) and be substantially contained within the yoke collar 68 in an unlocked position (shown in FIG. 9). The yoke collar 68 defines an aperture 72 through which the driver 52 extends, to thereby couple the driver 52 to the bolt 66. Rotation of the driver 52 in response to rotation of the thumbturn 48 or rotation of the key 36 in the key slot 62 causes the bolt 66 to extend and retract to thereby lock and unlock the lock 16. The yoke collar 68 further defines apertures 74 through which fasteners can extend to couple the latchbolt assembly 44 to the interior assembly 40 and the exterior assembly 42 upon installation. The yoke collar 68 can extend out of either the left or right side recesses 104 of the collar 102, depending upon the orientation of the lock 16 in the door upon installation. The plate 70 can define apertures 76 that receive fasteners that couple the plate 70 to a door. Various fasteners 78 are used to facilitate installation (see FIGS. 7-9).

The clamshell 14 is more clearly illustrated in FIGS. 5-9 and includes a first clamshell portion 80 and a second clamshell portion 82 that substantially mate to support the lock 16 with respect to the box 12. The illustrated clamshell 14 comprises a clear plastic material, such as polyvinylchloride, or PVC. The first clamshell portion 80 supports the exterior housing assembly 42 and the second clamshell portion 82 supports the interior housing assembly 40.

Figure 6:
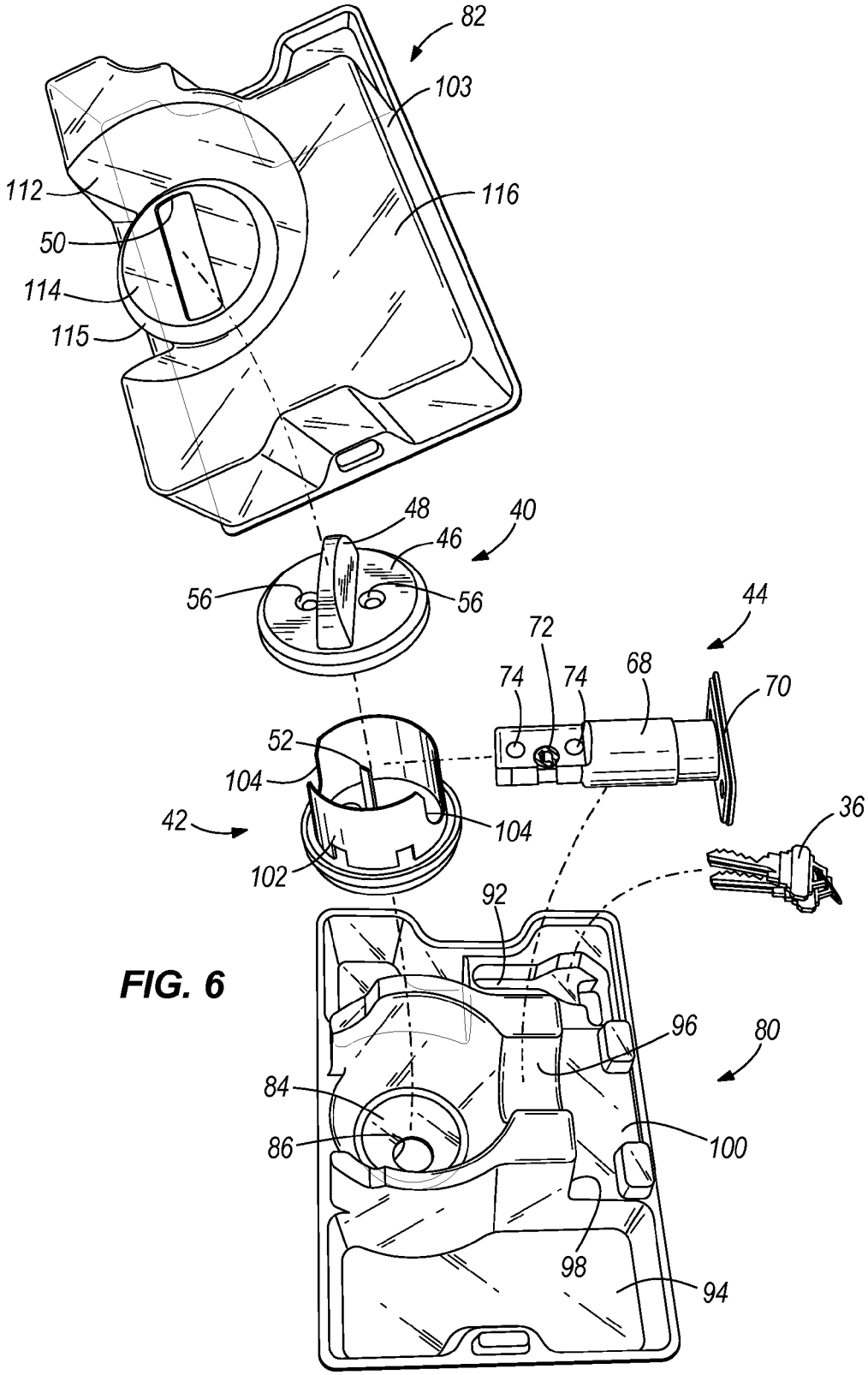
FIG. 6 is an exploded view of the plastic clamshell with a deadbolt lock assembly having a thumbturn.
Figure 7:
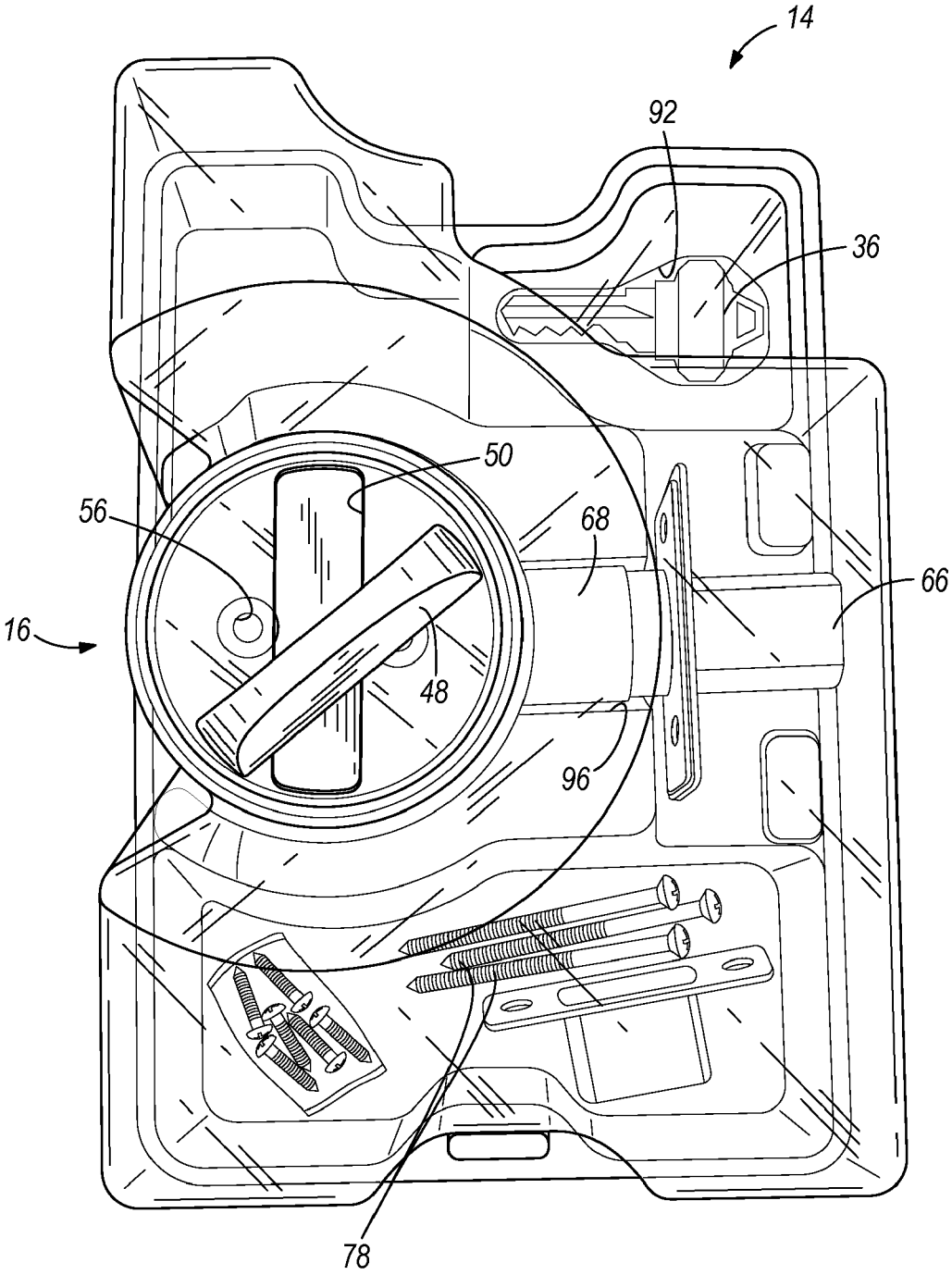
FIG. 7 is a view of the plastic clamshell and the deadbolt lock assembly with the thumbturn in a first position.
Figure 8:
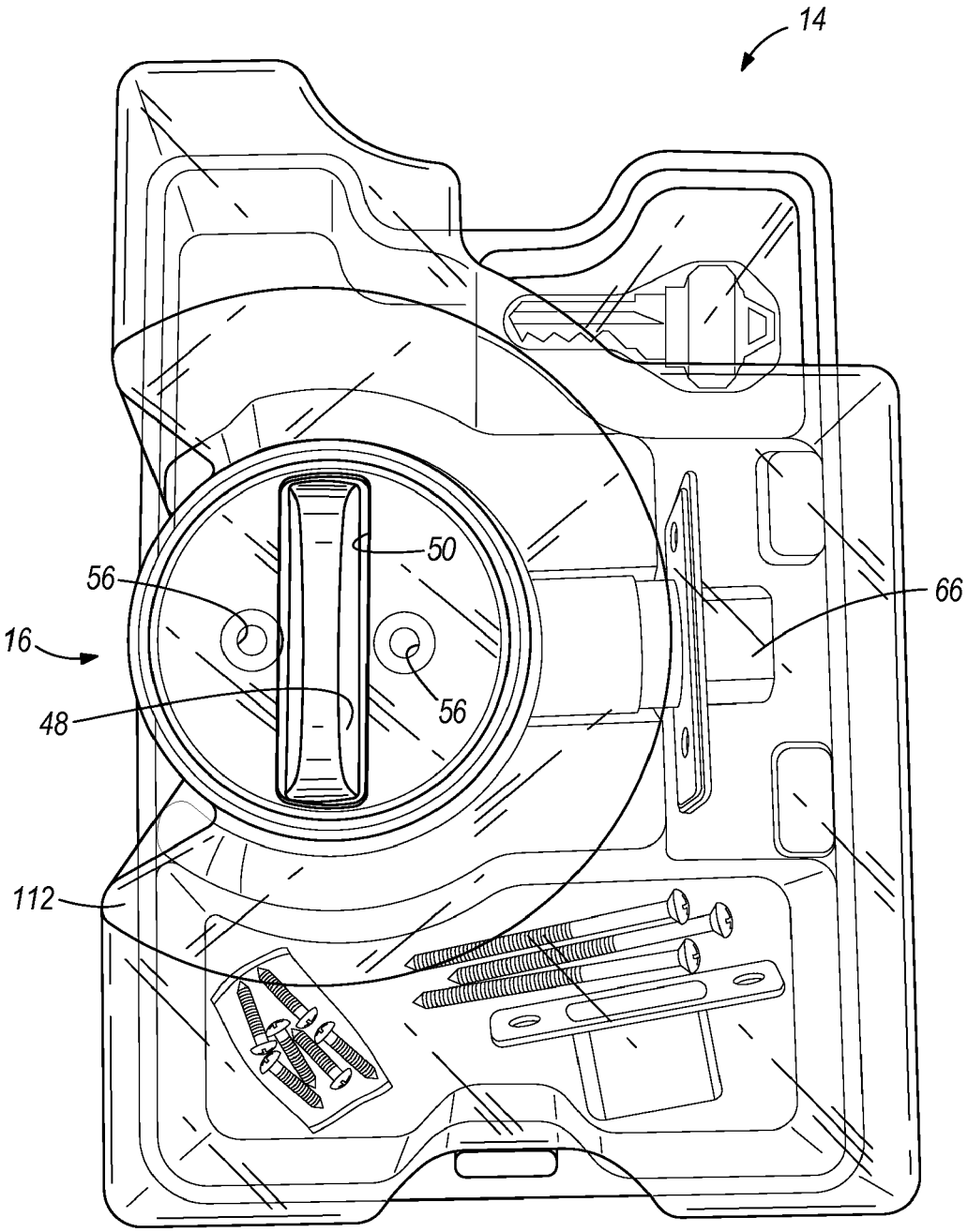
FIG. 8 is a view of the plastic clamshell and the deadbolt lock assembly with the thumbturn in a second position.
Figure 9:
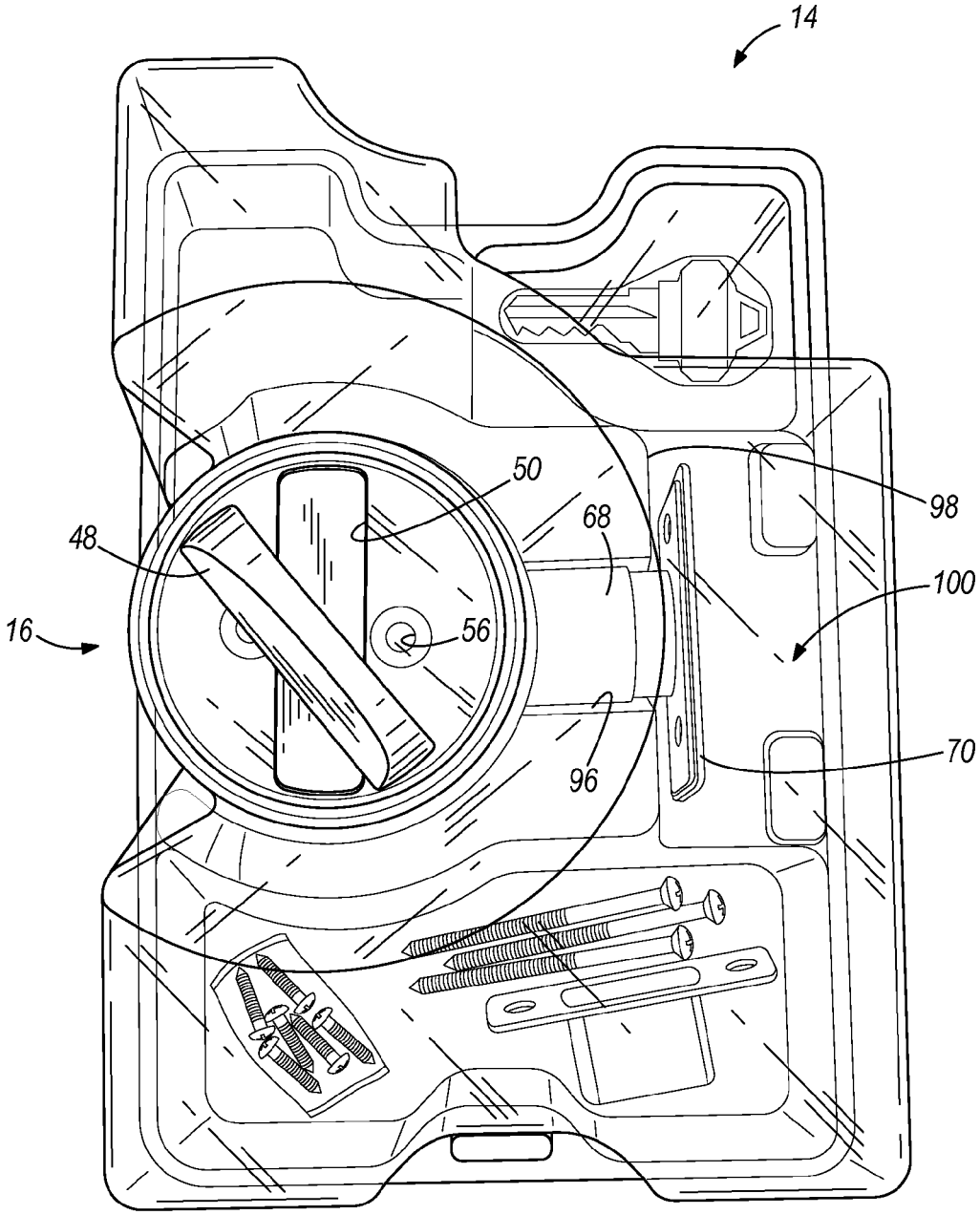
FIG. 9 is a view of the plastic clamshell and the deadbolt lock assembly with the thumbturn in a third position.
Figure 10:
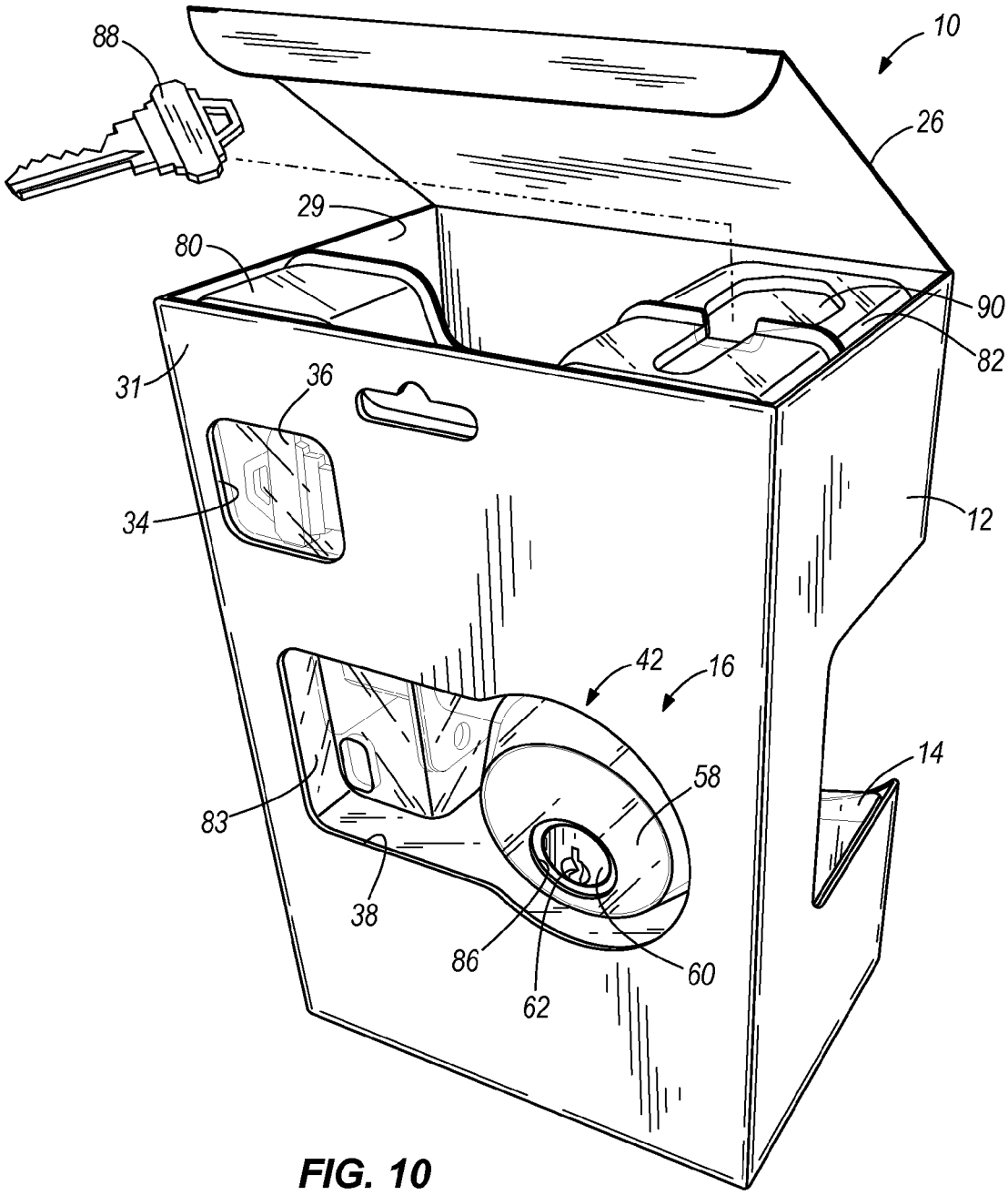
FIG. 10 is a rear perspective view of the packaging including a reset key.

The first clamshell portion 80 includes an inside surface 81 and an outside surface 83 (see FIGS. 6 and 10). The outside surface 83 contacts the inside surface 29 of the box 12. The inside surface 81 includes a recess 84 that is sized to receive the exterior housing assembly 42. The clamshell portion 80 defines an aperture 86 adjacent the lock cylinder 60 and aligned with the third window 38 to permit a tool, such as a reset key 88 (FIG. 10), to be inserted into the key slot 62 to reset or re-key the deadbolt assembly 16 while it is contained within the package 10. In other words, the deadbolt assembly 16 can be re-keyed without removing it from the package 10. The deadbolt assembly 16 can be re-keyed with a reset key included in the package 10, or it can be re-keyed with other keys or with other types of re-keying tools, any of which can be inserted through the aperture 86. In the illustrated embodiment, the reset key 88 is contained within a recess 90 in the top of the clamshell 14 (see FIG. 10). This permits a user to open the box 12 and remove the reset key 88 from the recess 90 without removing the clamshell 14 or the lock 16 from the box 12. The user can then insert the reset key 88 into the key slot 62 through the third window 38 and the aperture 86 to reset the lock cylinder 60. For information on how a reset key 88 can be used to reset the lock cylinder 60, reference can be made to U.S. patent application Ser. No. 12/138,950, filed Jun. 13, 2008, the content of which is herein incorporated by reference. In other embodiments, the aperture 86 and reset key 88 are not included, or just the reset key 88 is not included. Also, the recess 90 can be located elsewhere on the clamshell 14, although it is preferably on top so that the key 88 is easily accessible without removing the clamshell 14 from the box 12. It may be desirable to have the recess 90 entirely on one portion of the clamshell, such as on the portion 82 above the bolt 66, so that the recess 90 does not span the junction between the clamshell portions 80 and 82.

With continued reference to FIGS. 5-9, the inside surface 81 of the first clamshell portion 80 includes a key recess 92 that supports the key(s) 36 adjacent the second window 34. The first clamshell portion 80 further includes a recess 94 that is sized to support various loose components, such as screws, washers and a bolt collar, that facilitate installing the deadbolt lock assembly 16 on a door. In another embodiment, the various loose components can each be positioned in individual recesses. The first clamshell portion 80 also includes a channel 96 that supports the yoke collar 68 against the inside surface 81, and a surface 98 adjacent the plate 70. The first clamshell portion 80 further includes a recess or space 100 that permits free movement of the bolt 66 between its extended and retracted positions while the lock 16 is contained within the package 10.

The second clamshell portion 82 can be coupled to the first clamshell portion 80 in any known way, such as by mating protrusions and recesses, by use of fasteners, or simply held together by compression in the box 12. In the illustrated embodiment, one such protrusion 106 and one such mating recess 108 are illustrated. Additional protrusions and mating recesses are utilized to retain the clamshell portions 80, 82 together, such as at each corner of the clamshell portions 80, 82 and optionally along the left and right sides. These protrusions and recesses have a snap fit engagement to retain the clamshell portions 80, 82 together.

Figure 5:
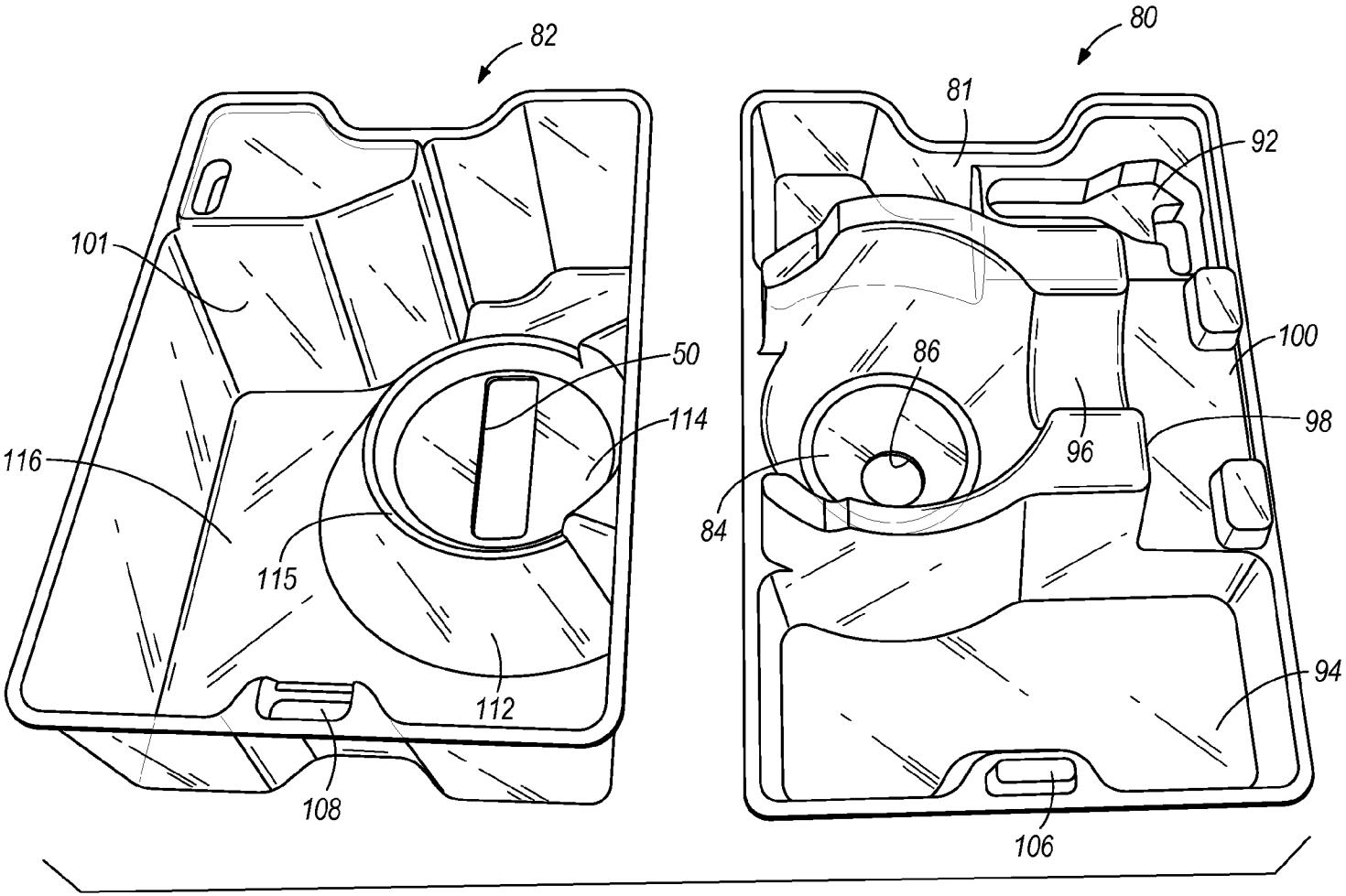
FIG. 5 is an exploded view of a plastic clamshell including two portions.

The second clamshell portion 82 includes an inside surface 101 and an outside surface 103 (see FIGS. 5 and 6). The outside surface 103 includes a planar front 116 that contacts the inside 29 of the box 12, to support the clamshell 14 within the box 12. The second clamshell portion 82 includes (see FIG. 2) a recess 112 that extends inward from the planar front 116 and toward the interior faceplate 46. The illustrated recess 112 is defined by an angled circular wall that forms a substantially truncated cone shape. The illustrated truncated cone shape extends around about two-thirds of a circle. The second clamshell portion 82 also includes a recessed planar portion 114 such that the inside surface of the recessed planar portion 114 contacts the faceplate 46. The inside surface 101 of the second clamshell portion 82 includes a rim 115 extending around the perimeter of the recessed planar portion 114. The rim 115 surrounds and engages the faceplate 46 to position the lock 16 in the package 10. The recess 112, the recessed planar portion 114 and the rim 115 support the faceplate 46 spaced inward from the box 12.

The interior assembly 40, the exterior assembly 42 and the latchbolt assembly 44 are secured together by the clamshell 14 without the use of fasteners, such that the lock 16 is operational while contained within the clamshell 14. The recessed portion 114 includes an aperture 50 through which the thumbturn 48 extends. The lock 16 is fully contained within the clamshell 14 except for the thumbturn 48. The thumbturn 48 extends out of the package 10 so that a consumer can grasp and rotate the thumbturn 48 while the lock 16 is contained within the package 10 to observe the "feel" of the lock 16 prior to purchasing the lock 16. This permits a consumer to purchase a lock based upon appearance and the feel of the lock without having to remove the lock 16 from its package 10 and without having to assemble the lock 16.

Assembly of the package 10 can include placing the first clamshell portion 80 on an assembly line, such as on a conveyor. The outside surface 83 of the clamshell portion 80 is positioned on the assembly line such that the inside surface 81 faces upward. The clamshell portion 80 functions as a tray to contain the components of the deadbolt lock assembly 16, as the deadbolt lock assembly 16 travels along the assembly line. First, the exterior housing assembly 42 is positioned in the recess 84 in the clamshell portion 80 adjacent the inside surface 81, such that the recesses 104 in the collar 102 are facing to the right and left sides, respectively. The latchbolt assembly 44 is then positioned on the exterior housing assembly 42 by inserting the driver 52 through the aperture 72 in the yoke collar 68. The latchbolt assembly 44 is retained in the clamshell portion 80 by a snap fit engagement between the yoke collar 68 and the channel 96. The interior housing assembly 40 is the positioned over the latchbolt assembly 44 and is supported by the collar 102 and the driver 52. The thumbturn 48 is rotated to an intermediate position (see FIG. 8), such that the thumbturn 48 will align with the aperture 50 in the second clamshell portion 82 as described below.

The key(s) 36 are inserted into key recess 92 and the various loose components, such as fasteners 78 are inserted into recess 94. The second clamshell portion 82 is placed over the first clamshell portion 80, with the inside surface 101 of the second clamshell portion 82 contacting the interior faceplate 46, and such that the thumbturn 48 fits through the aperture 50. The protrusions (one of which is 106) are pressed into a snap-fit engagement with the mating recesses (one of which is 108) to fix the clamshell portions 80, 82 together. The clamshell portions 80, 82 containing the lock 16 are then inserted into the box 12. The reset key 88 is optionally positioned in recess 90 and the top flap 26 of the box 12 is folded down to close the box 12, see FIG. 10.

The interior housing assembly 40, exterior housing assembly 42 and latchbolt assembly 44 are held together by the clamshell 14 and are operational within the clamshell 14, without the use of fasteners. The bolt 66 is viewable through the first window 32 and the clear plastic clamshell 14. The thumbturn 48 is graspable through the first window 32 to move the bolt 66 between locked and unlocked positions, while the lock 16 is in the package 10.

Various features and advantages of the invention are set forth in the following claims.

What is claimed is:

1. A method of packaging a lock including an interior housing assembly having an interior actuator, an exterior housing assembly, and a latchbolt assembly having a bolt moveable relative to the interior and exterior housing assemblies for operating the lock, the method comprising:

providing a package defining an aperture;

inserting one of the interior housing assembly and the exterior housing assembly into the package then inserting the latchbolt assembly into the package, such that a driver extends through an opening in the latchbolt assembly and is coupled to the one of the interior housing assembly and the exterior housing assembly;

then inserting the other of the interior housing assembly and the exterior housing assembly into the package, such that the driver is coupled to the other of the internal housing assembly and the external housing assembly, wherein the driver is pivoted in response to actuation of the interior actuator; supporting the interior housing assembly, the latchbolt assembly and the exterior housing assembly of the lock within the package, such that the lock is operational within the package; and closing the package with the operational lock inside the package and with the interior actuator extending through the aperture, such that the interior actuator is graspable and the lock is operational while the lock is inside the package and the package is closed.

2. The method of claim 1, wherein supporting the lock within the package includes enclosing the lock in an inner layer of the package, and placing the inner layer in an outer layer of the package.

3. The method of claim 1, wherein supporting the interior housing, the exterior housing and the latchbolt assembly together includes placing the lock components in a clamshell, such that the lock components are held together by the clamshell without the use of fasteners, and placing the clamshell in an outer layer of the package.

4. The method of claim 1, further comprising providing at least one window in the package, and aligning the window with the aperture, to permit viewing of the lock while the lock is positioned within the package.

5. The method of claim 1, further comprising using a first clamshell portion of the package as a tray moving along an assembly line, positioning the exterior housing in the tray, thereafter placing the latchbolt assembly on the exterior housing, such that the driver extends from the exterior housing through the opening in the latchbolt assembly, thereafter placing the interior housing on the latchbolt assembly, such that the driver extends into a recess in the interior housing, and placing other lock components into the tray, placing a second clamshell portion over the first clamshell portion to enclose the lock components within the clamshell, and inserting the clamshell and the enclosed lock components into a box forming an outer layer of the package.

6. The method of claim 1, wherein providing the package includes providing the package with an inner layer having therein the aperture and an outer layer having therein a window, wherein inserting the latchbolt assembly into the package includes enclosing the interior housing, the latchbolt assembly and the exterior housing in the inner layer of the package, and placing the inner layer in the outer layer of the package, and wherein the interior actuator extends through the aperture in the inner layer so that the interior actuator is accessible through the window in the outer layer.

7. The method of claim 1, wherein the lock has a key slot, and the package defines a second aperture and a second window adjacent the second aperture and the key slot to permit insertion of a key through the second window and the second aperture and into the key slot, and wherein the lock has a key cylinder including the key slot, and the key cylinder is coupled to the driver for rotation of the driver in response to rotation of a key within the key slot, to thereby permit operation of the lock without removing the lock from the package.

8. The method of claim 7, wherein a re-keying tool is positioned in the package to permit removal of the re-keying tool from the package, such that insertion of the re-keying tool through the second window and the second aperture and into the key slot permits re-keying of the lock while the lock is contained within the package.

9. A method of packaging a lock including a housing having a first portion and a second portion, an actuator coupled to one of the first portion of the housing and the second portion of the housing, and a bolt moveable relative to the housing in response to actuation of the actuator for operating the lock, the method comprising:

providing a package forming a rectangular solid having a perimeter defined by first and second parallel faces, third and fourth parallel faces and fifth and sixth parallel faces, the package defining an aperture;

inserting the first portion of the housing of the lock into the package; then inserting the bolt into the package; then inserting the second portion of the housing into the package, such that the bolt is moveable in response to actuation of the actuator; and closing the package with the housing, the actuator and the bolt of the lock inside the package, so that the housing, the actuator and the bolt of the lock are within the perimeter of the package defined by the faces of the package and the actuator is accessible through the aperture to permit operation of the lock while the lock is within the perimeter of the package and the package is closed.

10. The method of claim 9, wherein closing the package includes enclosing the housing in an inner layer of the package, extending the actuator through a window in the inner layer of the package, placing the inner layer in an outer layer of the package, the outer layer defining the rectangular solid, and aligning the window with the aperture to permit actuation of the actuator to move the bolt of the lock while the lock is contained within the perimeter of the package.

11. The method of claim 9, wherein inserting the housing, the actuator and the bolt includes securing the housing, the actuator and the bolt together within the package without the use of fasteners such that the lock is operational within the package.

12. The method of claim 11, wherein securing the housing, the actuator and the bolt together includes placing the lock components in a clamshell, such that the lock components are held together by the clamshell, and placing the clamshell in an outer layer of the package, the outer layer defining the rectangular solid.

13. The method of claim 9, further comprising using a first clamshell portion of the package as a tray moving along an assembly line, positioning the first portion of the housing in the tray, thereafter placing a latchbolt assembly including the bolt on the first portion of the housing, thereafter placing the second portion of the housing on the latchbolt assembly, placing other lock components into the tray, placing a second portion of the clamshell over the first portion of the clamshell to enclose the lock components within the clamshell, and inserting the clamshell and the enclosed lock components into a box forming an outer layer of the package, the outer layer defining the rectangular solid.

14. The method of claim 9, wherein providing the package includes providing the package with an inner layer having therein the aperture and an outer layer having therein a window, and wherein inserting the housing, the actuator and the bolt into the package includes enclosing the housing, the actuator and the bolt in the inner layer of the package, and placing the inner layer in the outer layer of the package, and wherein the actuator extends through the aperture in the inner layer so that the actuator is accessible through the window in the outer layer.

15. The method of claim 9, wherein the lock has key cylinder including a key slot, the aperture is positioned adjacent the key slot to permit insertion of a key through the aperture and into the key slot to permit actuation of the lock without removing the lock from the package.

16. A method of packaging a lock including an interior housing assembly, an exterior housing assembly including a key slot, and a latchbolt assembly having a bolt moveable relative to the exterior housing assembly for operating the lock, the method comprising:

providing a package defining an aperture;

inserting one of the interior housing assembly and and the exterior housing assembly into the package; then inserting the latchbolt assembly into the package; then inserting the other of the interior housing assembly and the exterior housing assembly into the package, such that the key slot is adjacent the aperture, such that a driver is coupled to the key slot and to the latchbolt assembly, and such that the lock is operational within the package; and closing the package with the interior housing assembly, the latchbolt assembly and the exterior housing assembly of the lock inside the package, such that a key can be inserted through the aperture into the key slot to permit operation of the lock.

17. The method of claim 16, wherein a re-keying tool is positioned in the package to permit removal of the re-keying tool from the package, such that insertion of the re-keying tool through the aperture and into the key slot permits re-keying of the lock while the lock is contained within the package.

18. The method of claim 16, wherein providing the package includes providing an inner layer having therein the aperture and an outer layer having therein a window, further comprising aligning the window with the aperture, wherein inserting the interior housing assembly, the latchbolt assembly and the exterior housing assembly into the package includes enclosing the interior housing assembly, the latchbolt assembly and the exterior housing assembly in the inner layer of the package and placing the inner layer in the outer layer of the package.

19. The method of claim 16, wherein inserting the interior housing assembly, the latchbolt assembly and the exterior housing assembly into the package includes securing the interior housing assembly, the latchbolt assembly and the exterior housing assembly together within the package without the use of fasteners, such that the lock is operational within the package.

20. The method of claim 19, wherein the interior housing assembly includes a key cylinder having a key slot, and the driver is coupled to the key cylinder for rotation in response to rotation of a key within the key slot.

21. The method of claim 19, further comprising providing at least one window in the package, and aligning the window with the aperture, to permit viewing of the lock while the lock is positioned within the package.

22. The method of claim 16, further comprising using a portion of the package as a tray moving along an assembly line, and placing components of the lock into the tray as the tray moves along the assembly line.

23. The method of claim 22, wherein the tray is a first portion of a clamshell, wherein placing components of the lock includes positioning the exterior housing assembly in the tray, thereafter placing the latchbolt assembly on the exterior housing, thereafter placing the interior housing assembly on the latchbolt assembly, and placing other lock components into the tray, wherein inserting the exterior housing assembly, the latchbolt assembly and the interior housing assembly into the package further includes placing a second portion of the clamshell over the first portion of the clamshell to enclose the lock components within the clamshell, and inserting the clamshell and the enclosed lock components into a box forming an outer layer of the package.

* * * * *